US006289720B1

(12) United States Patent
Ohkubo et al.

(10) Patent No.: US 6,289,720 B1
(45) Date of Patent: Sep. 18, 2001

(54) METHOD OF KNOCKING CONTROL OF INTERNAL COMBUSTION ENGINE

(75) Inventors: Minoru Ohkubo; Tohru Nakazono, both of Osaka (JP)

(73) Assignee: Yanmar Diesel Engine Co., Ltd., Osaka (JP)

( * ) Notice: Subject to any disclaimer, the term of this patent is extended or adjusted under 35 U.S.C. 154(b) by 0 days.

(21) Appl. No.: 09/341,609

(22) PCT Filed: Jan. 16, 1998

(86) PCT No.: PCT/JP98/00163

§ 371 Date: Jul. 14, 1999

§ 102(e) Date: Jul. 14, 1999

(87) PCT Pub. No.: WO98/31928

PCT Pub. Date: Jul. 23, 1998

(30) Foreign Application Priority Data

Jan. 20, 1997 (JP) ..... 9-007711
Jan. 20, 1997 (JP) ..... 9-007712

(51) Int. Cl.[7] ..... F02P 5/14
(52) U.S. Cl. ..... 73/35.01
(58) Field of Search ..... 73/35.01, 35.03, 73/35.04, 35.05, 35.06, 35.07, 116, 117.2, 117.3

(56) References Cited

U.S. PATENT DOCUMENTS 4,528,955 7/1985 Sugiura .
5,230,316 * 7/1993 Ichihara et al. .
5,408,863 * 4/1995 Sawyers et al. ..... 73/35.05
5,522,254 * 6/1996 Kamabora et al. ..... 73/35.05
5,535,722 * 7/1996 Graessley et al. .
5,598,822 * 2/1997 Fujishita et al. ..... 73/35.03
5,979,406 * 11/1999 Aoki et al. ..... 73/35.08
5,996,398 * 12/1999 Schleupen et al. ..... 73/35.05
6,000,276 * 12/1999 Mogi et al. ..... 73/35.08

FOREIGN PATENT DOCUMENTS 56-66727 6/1981 (JP) .
58-28646 2/1983 (JP) .
60-95190 5/1985 (JP) .
61-16267 1/1986 (JP) .
3-202661 9/1991 (JP) .
4-8628 2/1992 (JP) .
6-66195 3/1994 (JP) .
6-280728 10/1994 (JP) .
7-27011 1/1995 (JP) .
7-13507 2/1995 (JP) .

* cited by examiner

*Primary Examiner*—Eric S. McCall
(74) *Attorney, Agent, or Firm*—Jordan and Hamburg LLP

(57) ABSTRACT

A method for controlling knocking of an internal combustion engine in which a knocking signal and a combustion signal are formed by directing vibrations detected by a vibration sensor through a primary filter circuit including a combustion filter circuit and a knocking filter circuit. The combustion filter circuit and knocking filter circuit each include a time gate and a filter. A ratio of a representative value of the knocking signal to a representative value of the combustion signal is obtained and used to decide whether knocking is occurring. The output voltage of control signals generated based on the decision that knocking is occurring may be varied as a function of the strength of the knocking and/or the frequency of the knocking.

26 Claims, 8 Drawing Sheets

METHOD OF KNOCKING CONTROL OF INTERNAL COMBUSTION ENGINE

TECHNICAL FIELD

The present invention relates to a knocking control means for an internal combustion engine by combination of knocking detection means for detecting the knocking phenomenon generated in the internal combustion engine with knocking decision means for deciding the knocking on the basis of the detection results by use of the knocking decision means.

BACKGROUND OF THE INVENTION

Conventionally, vibrations caused by a knocking phenomenon generated in an internal combustion engine are detected as knocking detection signals by a knocking sensor, so that the knocking detection signals are allowed to pass through a filter circuit to remove noise components of low frequency and high frequency and only the knocking frequency component of specific frequency is allowed to pass, and thereafter, only the detected signal of a predetermined period is taken out to thereby compare a magnitude of wave form of the detected signal with a previously preset set value for decision, so as to decide whether the knocking exists or not, which is well-known as disclosed in, for example, the Japanese Patent Publication Gazette No. Hei 7-13507.

Conventionally, one vibration detector is used for detecting knocking vibrations from a plurality of cylinders, for example, three to four cylinders, and distances from respective cylinders to the vibration detector are different, so that even when the respective cylinders are equal in strength generated therein, the magnitudes of signal detected by the vibration detector are different from each other, whereby there has been the inconvenience that, regardless of generating the knocking, the signals detected by the vibration detector lead to decision of no knocking generation.

An extent of damage given to the engine, when the knocking is generated, changes according to the strength of knocking and frequency of knocking generation, whereby the ignition timing control, which is performed only by deciding the existence of knocking as conventional, is insufficient for the knocking avoid control, resulting in that the knocking cannot be avoided in spite of controlling.

SUMMARY OF THE INVENTION

A first object of the present invention is to provide a knocking detection method which makes equal the magnitude of detected signal of knocking vibration of the equal strength generated in a plurality of cylinders regardless of differences in distances and in loads between a knocking sensor and a cylinder corresponding thereto, thereby enabling performing an accurate knocking decision to be performed.

In a knocking control method for an internal combustion engine, which detects by at least one knocking sensor the vibrations caused by the knocking phenomenon generated in the internal combustion engine, the detected signals by each knocking sensor are allowed to pass through a plurality of sets of filter circuits of each one set of time gate which allows only vibrations generated for a specified time to pass and of filters which allow only vibrations of specified frequency to pass a knocking decision device calculates the detected signals obtained after passing through the plural sets of filter circuits so as to decide the knocking, and the control signals are outputted on the basis of the decision; the time gate of one set of the plural sets of filter circuits is used as a knocking part time gate set in a knocking generation time, the time gate of the other set is used as a combustion part time gate which has been set prior to the knocking generation time, the knocking part signal having passed through the knocking part time gate is allowed to pass through a knocking part filter which passes therethrough only the component of knocking frequency, in the other set of filter circuits, the combustion part signal having passed through the combustion part time gate passes through a combustion part filter which allows the component of excitation frequency in the cylinder, and are presentative value of knocking signals having passed through the knocking part time gate and knocking part filter is compared with that of combustion signal having passed through the combustion part time gate and combustion part filter so as to calculate a ratio of both the representative values to thereby use the calculated value for knocking decision.

A second object of the present invention is to provide a knocking decision method for an internal combustion engine, which enables the control signals outputted on the basis of knocking decision by the knocking decision device to correspond, in high precision, to the strength and frequency so as to accurately and efficiently avoid the knocking.

Hence, in the knocking control method which detects by a knocking sensor the knocking generated in the internal combustion engine and calculates the detected signals by the knocking decision device so as to decide the knocking and output the control signals on the basis of the decision, output voltage of control signal from the knocking device is changed correspondingly to the knocking strength, desirably, in proportion to n-th power of knocking strength. Also, the output voltage of control signals from the knocking decision device is changed correspondingly to the knocking strength and knocking generation frequency, for example, to a mean value of strength and generating frequency generated during the numbers of predetermined cycles, or a medium value of frequency in the frequency distribution obtained with respect to strength of knocking generated during the numbers of predetermined cycles, and desirably in proportion to m-th power of medium value of frequency in the frequency distribution, and further desirably to a value of n-th power of mean value of strength and that of m-th power of medium value of frequency in the frequency distribution.

A further object of the invention is to provide a knocking control method which applies the above-mentioned knocking detection method and knocking control method in order to simultaneously attain the first and second objects.

A PREFERRED EMBODIMENT OF THE INVENTION

Figure 1:
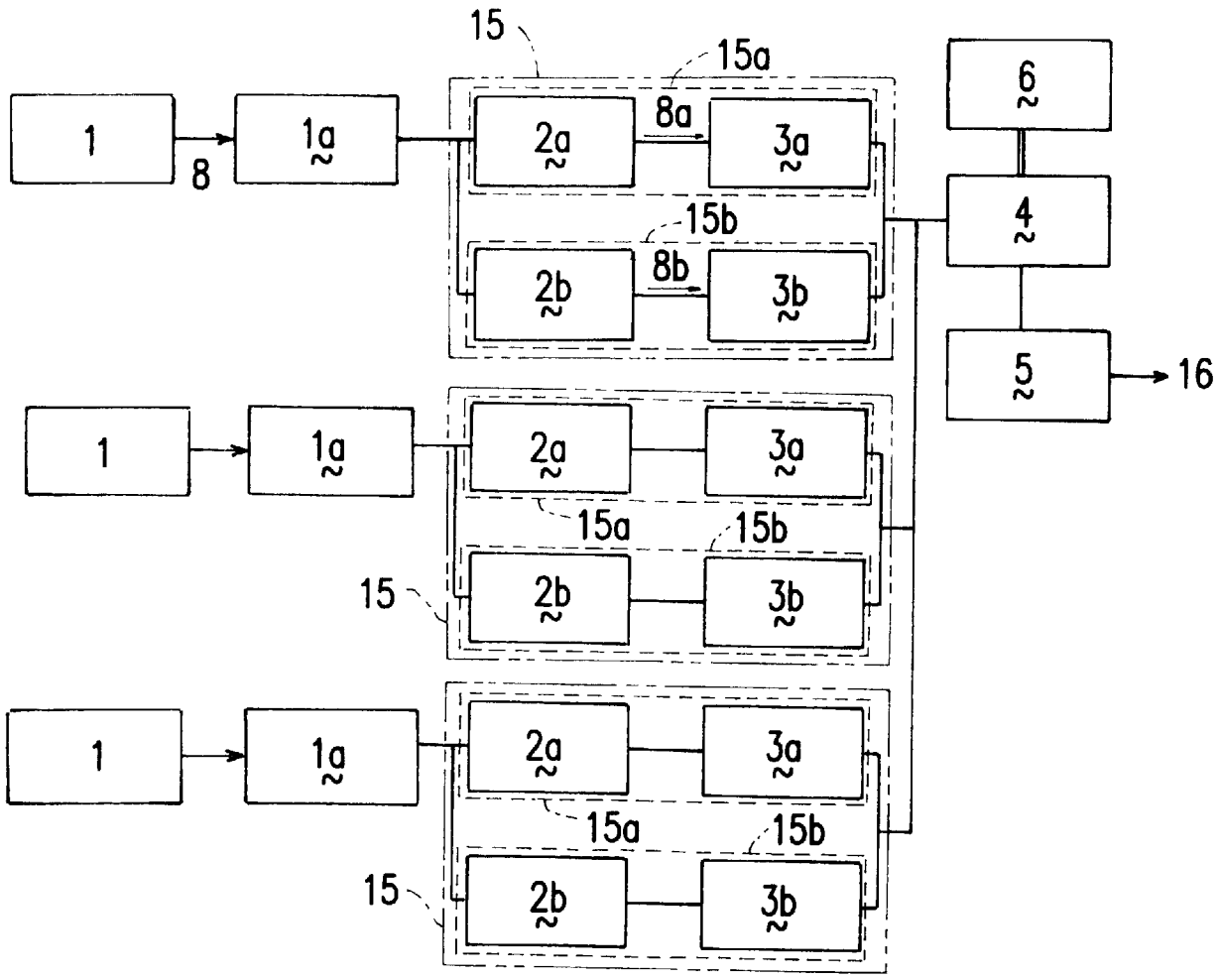
FIG. 1 is a block diagram showing a whole construction of a knocking detection method of the present invention.

Firstly, explanation in brief will be given on a knocking control method for an internal combustion engine applying a knocking detection method of the present invention in accordance with FIGS. 1 through 4, in which a knocking sensor 1 detects as analog signals vibrations due to the knocking phenomenon generated in the internal combustion engine (except for a diesel engine), so that the detected signals 8 are converted into digital signals by an A/D convertor 1*a*.

The detected signals 8 converted into digital signals pass through a time gate which allows only the signals generated for a predetermined period to pass, the time gate comprising combustion part time gates 2*a* and knocking part time gates 2*b*.

The combustion part signals 8*a* having passed through the combustion part time gates 2*a* are thereafter allowed to pass through combustion band pass filters (to be hereinafter called a combustion part filters) 3*a*, and low frequency and high frequency noise components are removed from a predetermined frequency, so that only combustion signals 10 of the specified frequency pass through the filter. Combination of one combustion part time gate 2*a* with one combustion part filter 3*a* is designated a set of combustion part filter circuits 15*a*.

The knocking part signals 8*b* having passed through the knocking part time gates 2*b* are thereafter allowed to pass through combustion band pass filters (to be hereinafter called "combustion part filters") 3*b* so as to remove the low frequency and high frequency noise components from the predetermined frequency and only knocking signals 9 of the specified frequency pass through the combustion part filter. One knocking part time gate 2*b* and one knocking part filter 3*b* are combined into one set of knocking part filter 15*b*.

The combustion signals 10 and knocking signals 9 having passed through the combustion part filters 3*a* and knocking part filters 3*b* are calculated by an arithmetic unit 4, the knocking is decided on the basis of the preset knocking decision set value 6, and converted into analog signals by a D/A convertor 5 on the basis of the decision, thereby outputting control signals 16. The arithmetic unit for making the knocking decision on the basis of knocking decision set value 6 and the D/A convertor 5 for outputting the control signals.

Also, a combustion part filter circuit 15 is constituted of a combustion part filter circuit 15*a* comprising the combustion part time gate 2*a* and a combustion part filter 3*a* and of a knocking part filter circuit 15*b* comprising a knocking part time gate 2*b* and a knocking part filter 3*b*.

In this embodiment, one knocking sensor 1 detects vibrations for one cylinder and the one knocking sensor 1 corresponds to the filter circuit 15 comprising two sets of filter circuits 15*a* and 15*b*. Regarding one filter circuit 15, the combustion part time gate 2*a* at the combustion filter circuit 15*a* is properly set in timing of explosion in each corresponding cylinder and the knocking part time gate 2*b* at the knocking filter circuit 15*b* is properly set in knocking timing of the corresponding cylinder.

Thus, the detected signals from each knocking sensor 1 for detecting vibrations of each cylinder are simultaneously processed by two different filter circuits 15*a* and 15*b*, thereby enabling the detected signal to be processed correspondingly to distances from each cylinder to the knocking sensor 1. In this embodiment, three cylinders are used, three knocking sensor are used, and three filter circuits 15*a* are provided, in which the numbers of knocking sensor 1 and filter circuit 15 may be adjusted correspondingly to the number of cylinders.

Also, it is not indispensable to detect vibrations or one cylinder by one knocking sensor 1. For example, one knocking sensor may detect vibrations for two or three cylinders equal in distance therefrom. In this case, one filter circuit 15 is constituted of combustion part filter circuits 15*a* and of knocking part filter circuit 15*b* correspondingly to the combustion time (to be hereinafter called combustion time T1) and the knocking generation time (to be hereinafter called the knocking generation time T2) of the respective detected signals of a plurality of cylinders by one knocking sensor.

The combustion part time gates 2*a* are constructed to allow only the combustion signals 8*a* among the detected signals 8 detected in the combustion time T1 before the knocking generation time to pass the same and the knocking part time gates 2*b* are constructed to pass only the knocking part signal 8*a* among the detected signals detected by the knocking generation time T2.

Figure 2:
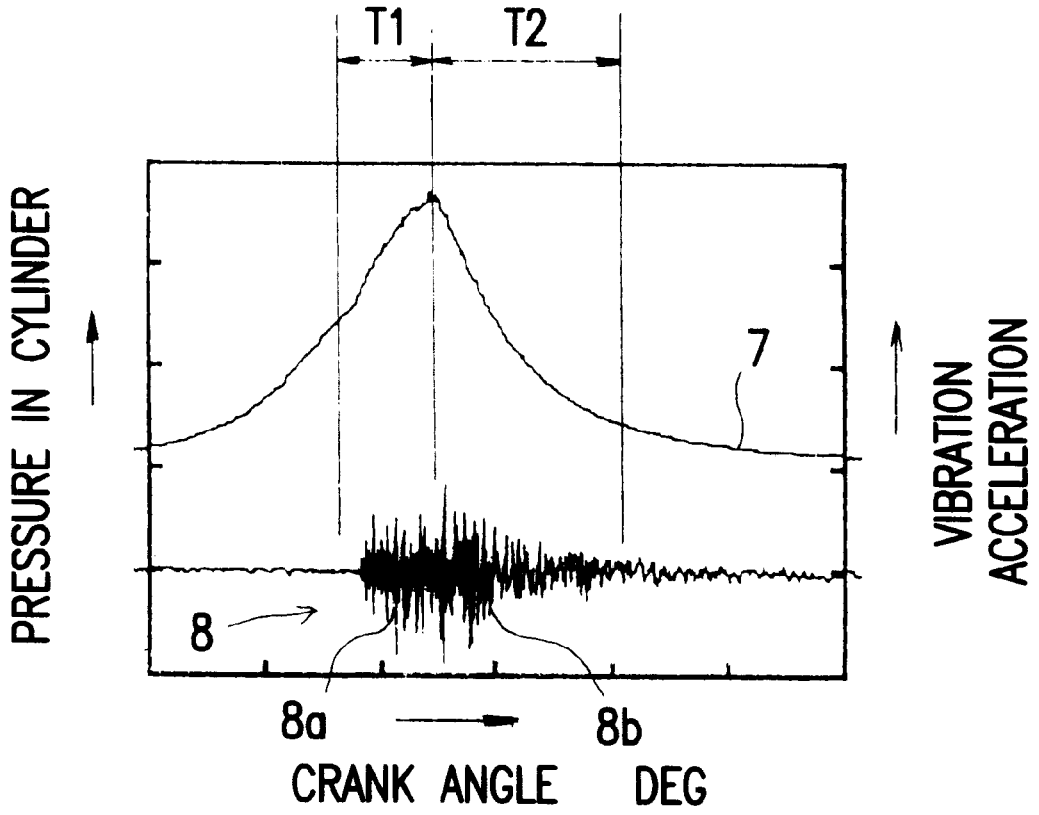
FIG. 2 is a view showing a relation between a crank angle, pressure in a cylinder and vibration acceleration.

Here, in FIG. 2, a pressure curve 7 representing a relation between the pressure in cylinder and the crank angle and a vibration curve, that is, the detected signals 8, representing a relation between the vibration acceleration and the crank angle are shown.

The detected signals 8 are divided into the combustion part signals 8*a* and knocking part signals 8*b* due to the generation time, the combustion part signals 8*a* being signals due to vibrations generated by the normal combustion phenomenon in the combustion time T1, the knocking part signals 8*b* being signals including vibrations by generation of knocking in the knocking generation time T2.

The knocking part signals 8*b* having passed through the knocking part time gate 2*b* pass through the next knocking part filter 3*b* and are removed of the low frequency and high frequency noise components from a predetermined frequency and only the detected signals of specified frequency pass through the filter 3*b*.

In other words, the vibration frequency generated by knocking is determined by a diameter (bore) of cylinder and the combustion temperature, whereby the low frequency side cutoff frequency FL and high frequency side cutoff frequency FH of knocking part filter 3*b* are set to remove the frequency other than the frequency band.

Figure 3:
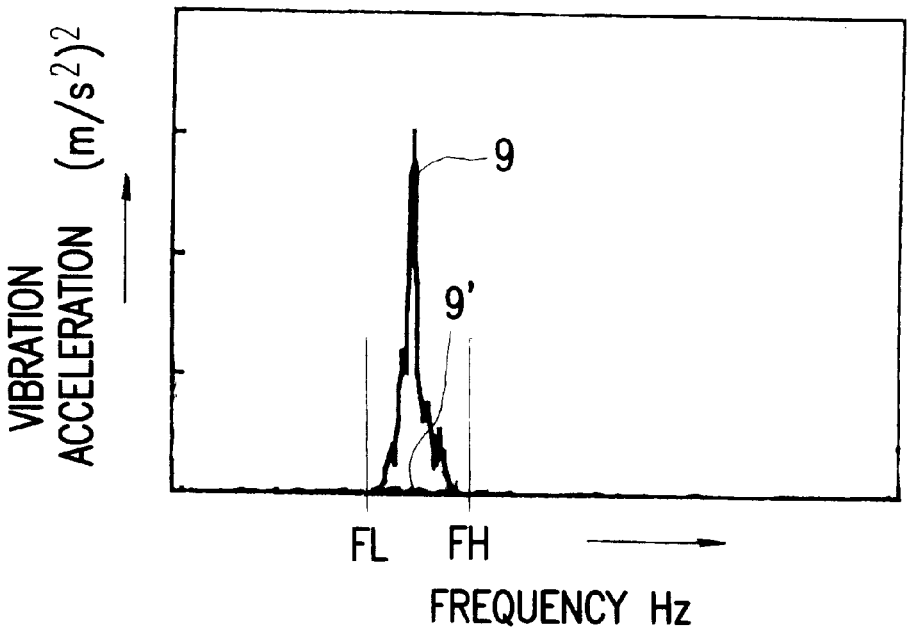
FIG. 3 is a view showing cutoff frequency of a knocking part filter.

As shown in FIG. 3, the knocking part signals 8*b* pass through the knocking part filter 3*b* and become knocking signals 9 including only the frequency component generated by knocking, and, when no knocking is generated, become knocking signals, 9', so that it is shown that vibrations are scarcely generated in the frequency band between the frequencies FL and FH in the knocking generation time T2.

On the other hand, the combustion part signals 8*a* having passed the combustion part time gate 2*a* next pass through the combustion part filter 3*a* and the low and high frequency noise components are removed from the predetermined frequency so that only the detected signals of specified frequency pass. In other words, among the combustion part signals 8*a* of detected signals of vibrations caused by the combustion, the low frequency side cutoff frequency FL' and high frequency side cutoff frequency FH' of the combustion part filter 3*a* are set, in order to allow only the frequency components exciting and resonating in cylinders to pass.

Figure 4:
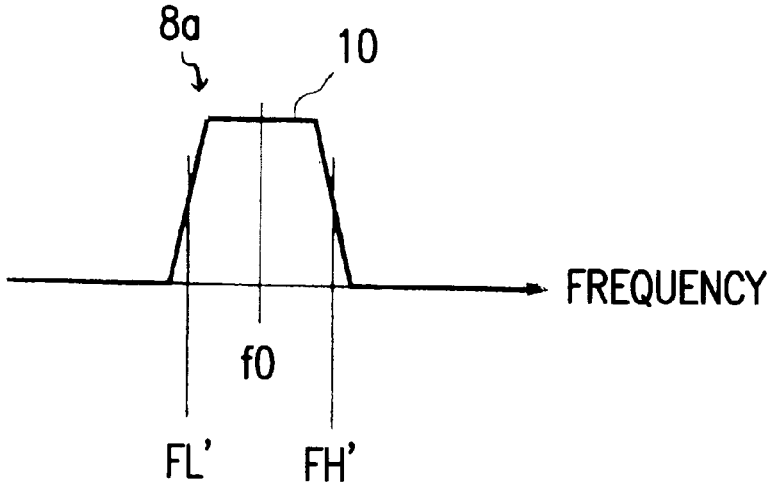
FIG. 4 is a view showing frequency of a combustion part filter.

As shown in FIG. 4, the combustion part signals 8*a* pass through the combustion part filter 3*a* so that both ends thereof are cut off to be combustion signals 10. The low frequency side cutoff frequency FL' and high frequency side cutoff frequency FH' change due to the form or size of cylinder, but in a case of this embodiment, the frequency FL'=300 Hz and that FH'=20 KHz are set. In addition, unless the combustion part filter 3*a* is provided the object of the invention is attainable.

Thus, the knocking signals 9 (9') and combustion signals 10 having passed the filter circuit 15 are calculated by the arithmetic and logic unit 4 and decision-detected values are calculated to be decided in comparison with the knocking decision set values 6.

Figure 5:
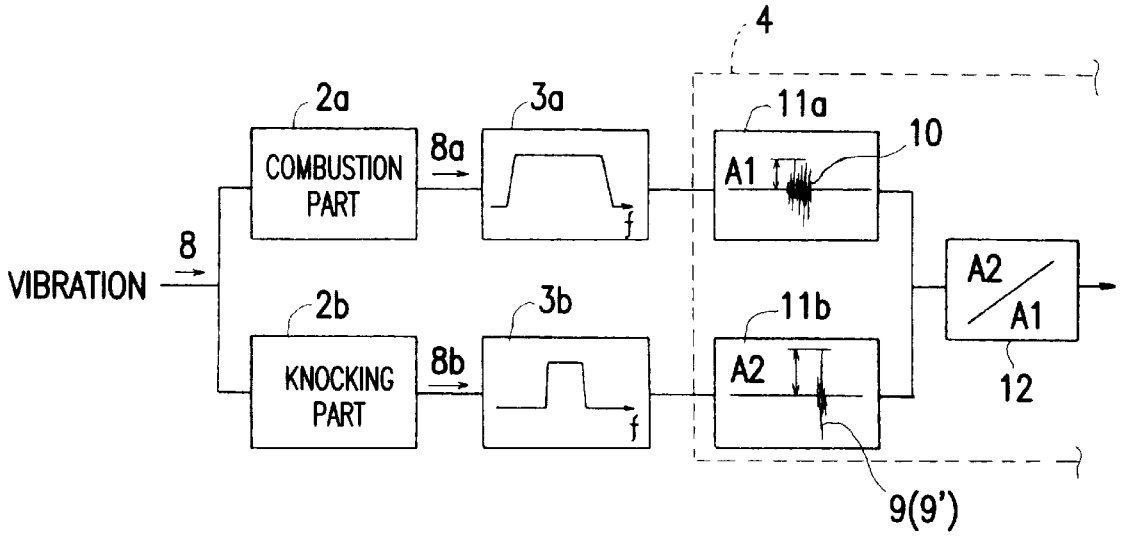
FIG. 5 is a block diagram of an embodiment of a calculation method of a decision detected value.

An embodiment of calculation method for the decision-detected values will be explained in accordance with FIG. 5. The detected signals 8 detected by the knocking sensor 1 and digitized pass through the combustion part time gate 2*a* and combustion part filter 3*a* so as to be the combustion signals 10, and pass through the knocking part time gate 2*b* and knocking part filter 3*b* so as to be the knocking signals 9(9'). A maximum value A1 of combustion signals 10 is measured by a measuring part 11*a* of arithmetic unit 4 and a maximum value A2 of knocking signals 9(9') is measured by a measuring part 11*b* of arithmetic and logic unit 4.

Thus, in the filter circuit 15, the time gate is divided into the combustion part time gate 2*a* set prior to the knocking generating time and the knocking part time gate 2*b* set in the knocking generation time, so that the detected signals 8 detected by the knocking sensor can be divided by generating time of detected signals into the combustion part signal 8*a* caused by vibration generated from the normal combustion phenomenon in the combustion time and knocking part signals 8*b* including vibrations caused by knocking generation in the knocking generation time. Furthermore, these signals are allowed to pass through the filters 3*a* and 3*b* respectively, whereby it has been possible to take out only the components, such as the knocking signals 9(9') and combustion part signals 10 including only the frequency components (frequency components resonating and exciting in the cylinder), which are required to the knocking decision.

A ratio of maximum values A1 to A2 is calculated so that, for example, a value of dividing the maximum value A2 by that A1 (A2/A1) is obtained to be a decision-detected value 12, thereby comparatively decide the decision detected value 12 to the knocking decision set value 6.

Figure 6:
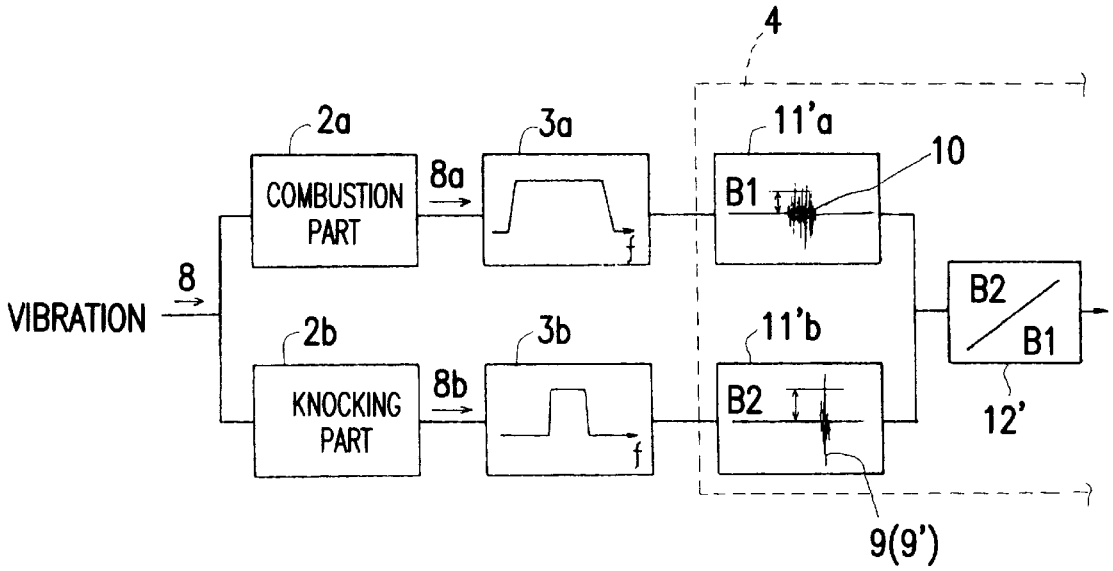
FIG. 6 is a block diagram of a modified embodiment of the same.

Next, explanation will be given on a modified embodiment of calculating the decision-detected values in accordance with FIG. 6. The detected signals 8 detected and digitized by the knocking sensor 1 pass through the combustion part time gate 2*a* and combustion part filters 3*a* to be combustion signals 10 and pass through the knocking part gate 2*b* and knocking part filter 3*b* to be knocking signals 9(9'). An effective value B1 of combustion signals 10 is measured by a measuring part 11'*a* and an effective value B2 of knocking signals 9(9') is measured by a measuring part 11'*b* of arithmetic and logic unit 4.

The ratio of effective values B1 and B2 is calculated and, for example, a value of dividing the effective value B2 by that B1 (B2/B1) is obtained as the decision-detected value 12', which is comparatively decided with the knocking set value 6 (different in value from the knocking set value 6 for deciding the decision-detected values 12).

Thus, the representative values of maximum and effective values of knocking signals 9(9') and combustion signals 10 are measured to calculate a ratio of both the values, the ratio being comparatively decided with the knocking decision set values 6.

The representative values of knocking signals 9(9') and combustion signals 10 are not limited to the maximum value or the effective value, but may use other values.

The ground of using the ratio of representative values of knocking signals 9(9') and combustion signals 10 as the decision-detected values. Even if the knocking of equal strength is generated, the magnitude of vibrations detected by the knocking sensor is different when the distance from the knocking sensor 1 to the cylinder or the quantity of load applied to the engine is different, so that when only the knocking signals 9 are comparatively decided with the knocking set values 6, the decision result may be different in spite of the knocking of equal strength.

However, the knocking of equal strength, even when the magnitude of vibrations detected by the knocking sensor 1 is different, is not changed in the ratio of the combustion signals 10 and the knocking signals 9, so that the ratio of respective representative values of, for example, the maximum values A1 and A2, is calculated, or the ratio of the effective values B1 and B2 is calculated, so as to comparatively decide the calculated ratio with the knocking decision set value 6, thereby enabling the same decision results to be always obtained.

Therefore, in a case that the knocking of equal strength is generated, even when the distance from the knocking sensor to the cylinder or the load applied to the engine is different, a constant value can be obtained for the decision detected value of comparatively deciding the knocking value with the knocking decision set value, thereby enabling the same decision result to be always obtained.

Figure 7:
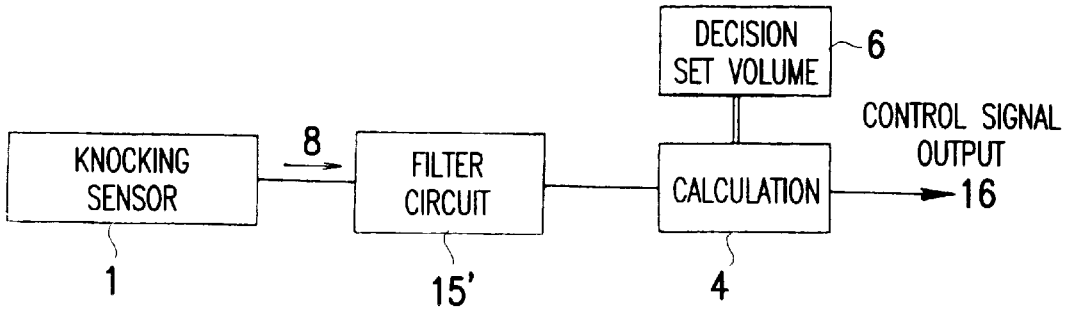
FIG. 7 is a block diagram showing a whole construction a of knocking detection device using the knocking detection method of the present invention.

Next, explanation will be given on a skeleton of construction of knocking control method applying thereon the knocking decision method of the present invention in accordance with FIG. 7. The vibrations, such as the knocking phenomenon, generated in the internal combustion engine (except for the diesel engine) are detected by the knocking sensor 1, the detected signals 8 are allowed to pass through the A/D convertor 1*a* (not shown) as the same as the above-mentioned to be digitized, and further are allowed to pass through a filter circuit 15' housing therein a time gate for allowing only the signals generated in a predetermined time and a band pass filter for removing the low and high frequency noise components from the predetermined frequency so as to allow only the signal of specified frequency. The filter circuit 15' may apply the filter circuit 15 of the above-mentioned construction (comprising the combustion filter circuit 15*a* and knocking filter circuit 15*b*), or other construction. The detected signals having passed through the filter circuit 15' are calculated by an arithmetic unit 4 and decided of an extent knocking strength or frequency on the basis of knocking decision set value 6, and an output signal 16 corresponding to the decision result is allowed to pass through the D/A convertor (not shown) as the same as above-mentioned and outputted therefrom, the arithmetic and logic unit 4 and knocking decision set value 6 forming a knocking decision device.

In a case that the filter circuit 15 of the above-mentioned construction is used for the filter circuit 15', the filter circuits 15 are provided corresponding to the member cylinders, so as to obtain combustion signals and knocking signals 9(9'), and further the arithmetic and logic unit 4 is used to obtain decision-detected values 12(12') from the combustion signals 10 and knocking signals 9(9') so as to be comparatively decided with the decision set values 6, whereby enabling the knocking decision to be obtained, which is not controlled by a difference in the distance from the cylinder to the knocking sensor 1 or the load applied to the engine.

Figure 8:
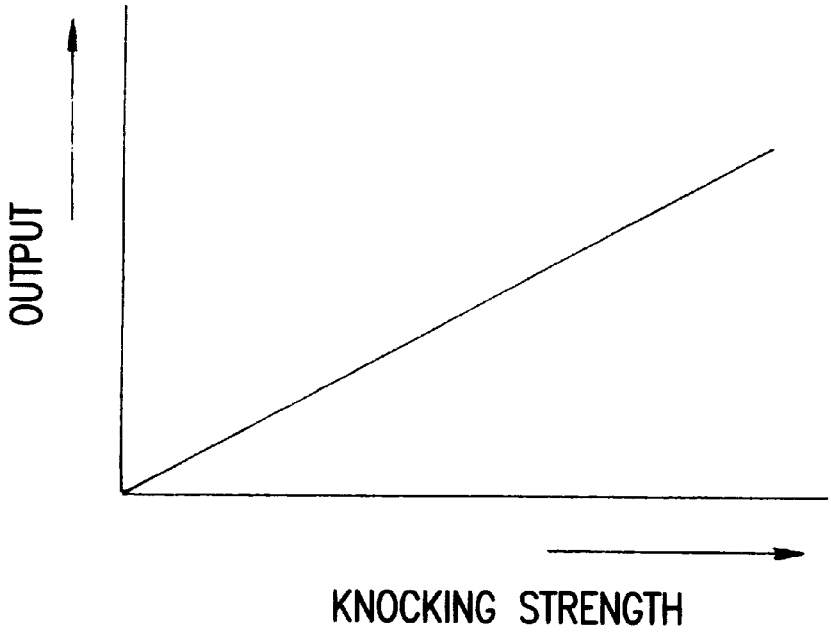
FIG. 8 shows a relation between the knocking strength and the output voltage of control signals.

Next, explanation will be given on a knocking decision method using the knocking decision device. The detected signals having passed through the filter circuit 15' is measured of the quantity wave form (the quantity decision-detected value 12 or 12' when the filter circuit 15 is used) in the arithmetic and logic unit 4, the quantity of measured wave form, that is, the knocking strength, is compared with the knocking decision set value 6 so as to determine voltage of outputted signal, in which case, as shown in FIG. 8, the knocking decision set value 6 is set so as to output control signals 16 of quantity in proportion to the knocking strength.

Figure 9:
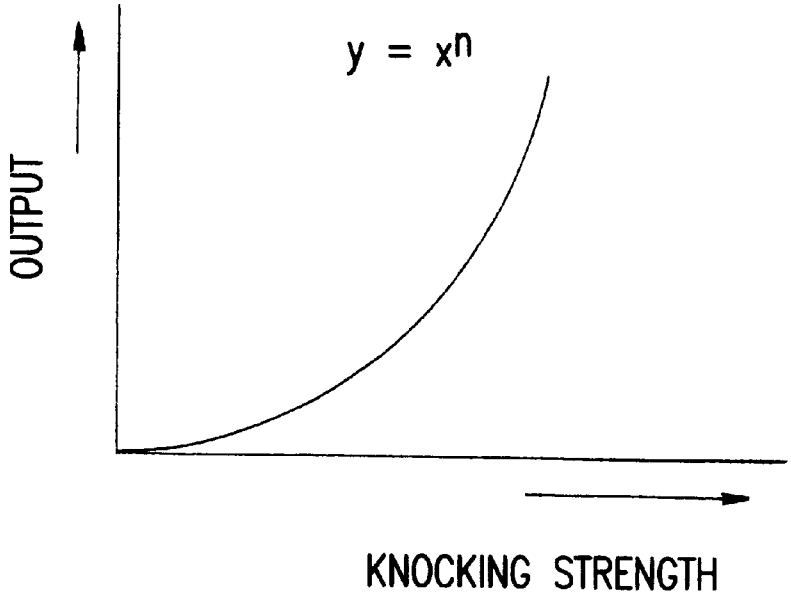
FIG. 9 shows a modified embodiment of the same.

Generally, the magnitude of damage given to the knocking strength and engine has a relation of (magnitude of damage)=(knocking strength)$^n$(n: plus real number). Hence, as shown in FIG. 9, the knocking decision set value 6 can be set to output a signal of magnitude proportional to a value of n-th power (n: plus real number) of knocking strength.

Thus, the control signals 16 of magnitude proportional to the knocking strength are outputted, so that, for example, the ignition time when the generated knocking strength is larger, can be largely corrected and, when smaller, be corrected small, whereby the knocking can accurately be avoided so as to largely reduce the damage onto the engine.

Furthermore, since a magnitude of damage given to the engine changes by being subjected to both the knocking strength and frequency of knocking generation, in order to accurately avoid the knocking, the knocking strength and frequency of generating knocking must change the magnitude of outputted signal.

Figure 10:
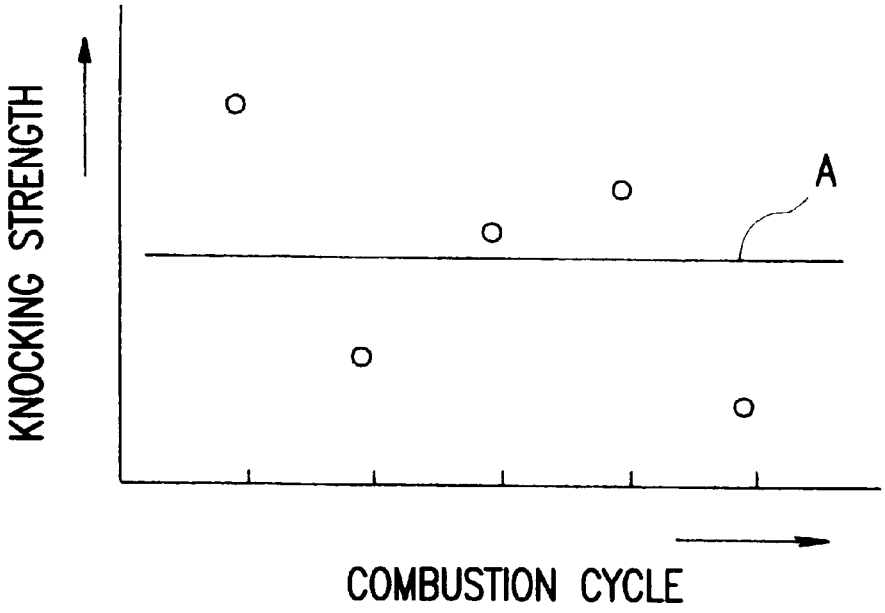
FIG. 10 shows a relation between the combustion cycle and the knocking strength, and a mean value of knocking strength.
Figure 11:
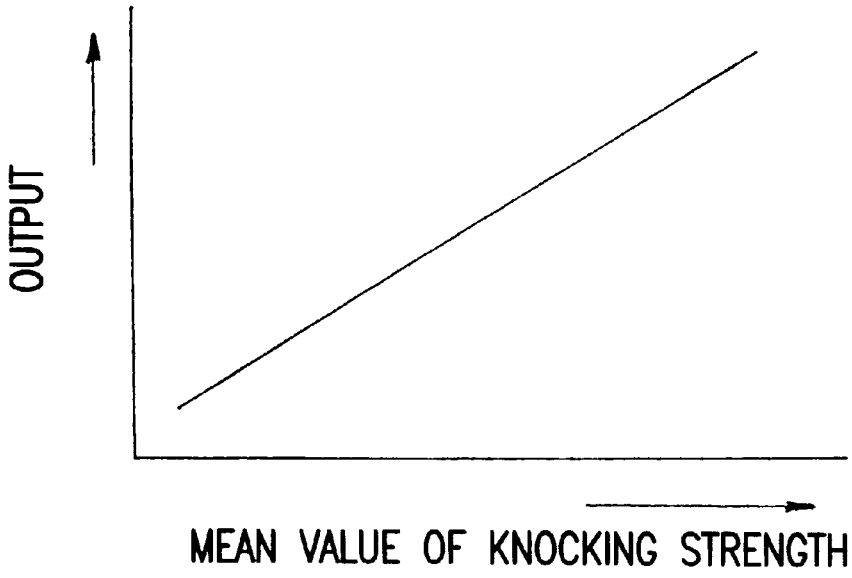
FIG. 11 shows a relation between the mean value of knocking strength and the output voltage of control signals.

Hence, in order to change the magnitude of outputted signal, the arithmetic and logic unit 4 of knocking decision device is constructed as follows. For example, FIG. 10 is a graph showing a relation between the combustion cycle of engine and the strength of generated knocking, in which the knocking strength generated in each cycle represents plots so as to indicate a strength mean value A of averaging the respective strength values.

Also, a frequency mean value of averaging the knocking generation frequencies in the strength is calculated, so that a control signal of magnitude in proportion to the frequency mean value may be outputted.

Figure 12:
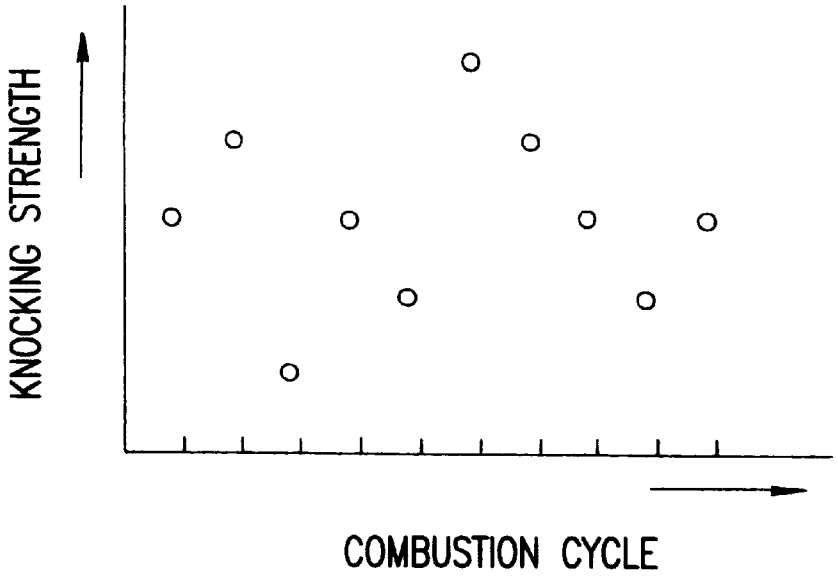
FIG. 12 shows a relation between the combustion cycle and the knocking strength.
Figure 13:
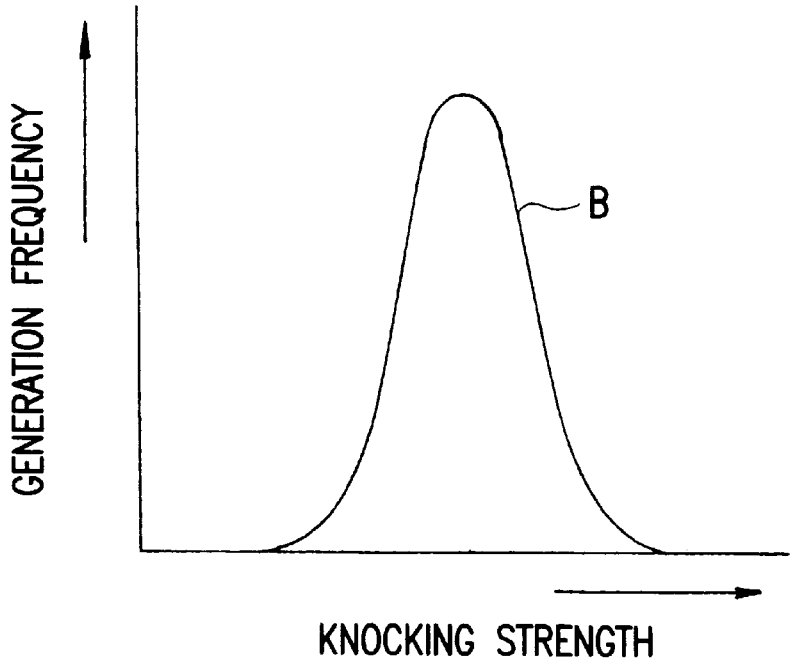
FIG. 13 shows a relation between the knocking strength and the knocking generation frequency.

The following method can be applied. FIG. 12 shows a relation between the combustion cycle of engine and the strength of generated knocking, and the knocking strength generated in each cycle is plotted. A generation frequency distribution curve as shown in FIG. 13 is calculated to obtain a medium value of frequencies so as to output a control signal of magnitude in proportion to the medium value.

The control signal of magnitude corresponding to both the knocking strength and generation frequency is outputted to change a correction amount of ignition time so as to enable the knocking to be efficiently and exactly avoided.

Regarding the knocking frequency, for example, the output voltage of control signal 16 may be changed correspondingly to the mean value of frequencies and the medium value of frequency distribution.

Generally, the magnitude of damage given to the engine, the knocking strength and the knocking generation frequency when the knocking is generated, have a relation of (magnitude of damage)=(knocking strength)$^n$×(generation frequency)$^m$(n and m: plus real numbers), where, when it is constructed that the control signal 16 proportional to the value of m-th power (m: plus real number) of medium value of frequency is also outputted, the knocking can efficiently be avoided.

Furthermore, in order to highly efficiently and accurately avoid the knocking, the control signal 16 of magnitude in proportion to a value of the n-th power of knocking strength (n: plus real number)) and of m-th power of medium value of frequency (m: plus real number) is outputted to enable the correction quantity of ignition time to be changed.

As above-mentioned, the control signal, which affects the magnitude of damage given to the engine, knocking strength and generation frequency when the knocking is generated, is outputted to thereby enable the knocking to be exactly avoided.

Even when the knocking form, such as lean burn or three way catalyst, is different, the same method can detect and decide the knocking. In other words, even when knocking of various forms are generated, the damage given to the engine can efficiently and accurately be avoided.

INDUSTRIAL APPLICABILITY

The knocking detection method and decision method of the present invention are applied to a multi-cylinder internal combustion engine, except for a diesel engine, which generates knocking always in a combustion chamber, whereby an internal combustion engine of high performance, which accurately detects knocking in each cylinder, exactly and efficiently decides whether the knocking is to be avoided with respect to the detected knocking, and performs operations of control means on the basis of knocking, and performs operations of control of ignition time, correspondingly to the knocking strength and frequency in high precision. Even in the internal combustion engine different in knocking form, for example, using the lean burn or three way catalyst, such the knocking control method is used so as to enable the internal combustion engine of high performance to be provided.

What is claimed is:

1. A knocking control method for an internal combustion engine, comprising the steps of:

detecting vibrations caused by knocking phenomenon generated in the internal combustion engine by means of at least one knocking sensor, generating a knocking signal representative of knocking in at least one cylinder of the engine and a combustion signal representative of combustion in the at least one cylinder by directing the vibrations detected by each knocking sensor into a respective primary filter circuit including a knocking filter circuit for generating the knocking signal and a combustion filter circuit for generating the combustion signal, the knocking filter circuit and the combustion filter circuit each comprising a time gate for allowing only vibrations generated in a specified time to pass therethrough and a filter for allowing only vibrations of specified frequency to pass through, the knocking filter circuit having a time gate of different specified time and a filter of different specified frequency than the combustion filter circuit, deciding whether knocking exists based on an analysis of the knocking signal and the combustion signal from each primary filter circuit, determining the strength of the knocking based on the knocking signal from each primary filter circuit, and generating control signals for controlling the knocking in the at least one cylinder based on the decision as to whether knocking exists and which are set relative to the strength of the knocking.

2. A knocking control method for an internal combustion engine as set forth in claim 1, further comprising the step of setting the specified time in which the time gate of the combustion filter circuit allows vibrations to pass through to precede the specified time in which the time gate of the knocking filter circuit allows vibrations to pass therethrough for each combustion cycle.

3. A knocking control method for an internal combustion engine as set forth in claim 1, further comprising the step of designing the filter of the combustion filter circuit to allow only frequency components exciting in the at least one cylinder to pass through.

4. A knocking control method for an internal combustion engine as set forth in claim 1, further comprising the step of designing the filter of the knocking filter circuit to allow only components of a knocking frequency to pass through.

5. A knocking control method for an internal combustion engine as set forth in claim 1, wherein the step of deciding whether knocking exists based on an analysis of the knocking signal and the combustion signal comprises the steps of calculating a ratio of a representative value of the knocking signal to a representative value of the combustion signal and using the ratio to decide whether knocking exists.

6. A knocking control method for an internal combustion engine, comprising the steps of:

detecting knocking in the engine by means of a knocking sensor;

determining the strength of the detected knocking; and generating control signals for controlling the knocking in the engine, the step of generating control signals comprising the step of determining an output voltage of the control signals as a function of the n-th power of the strength of the detected knocking, n being greater than 1.

7. A knocking control method for an internal combustion engine, comprising the steps of:

detecting knocking in the engine by means of a knocking sensor;

determining the strength of the detected knocking;

determining the frequency of the knocking in the engine from the detected knocking during a number of combustion cycles; and generating control signals for controlling knocking in the engine, the step of generating control signals comprising the step of determining an output voltage of the control signals as a function of the strength of the detected knocking and the frequency of the knocking during the combustion cycles.

8. A knocking control method for an internal combustion engine as set forth in claim 7, wherein the step of determining the output voltage as a function of the strength of the knocking and the frequency of the knocking comprises the step of determining the output voltage as a function of mean values of the strength of the knocking and the frequency of the knocking during the combustion cycles.

9. A knocking control method for an internal combustion engine as set forth in claim 7, further comprising the step of determining the distribution of the frequency of the knocking with respect to the strength of the knocking generated during the combustion cycles, the step of determining the output voltage as a function of the strength of the knocking and the frequency of the knocking comprising the step of determining the output voltage as a function of the frequency distribution.

10. A knocking control method for an internal combustion engine as set forth in claim 9, wherein the step of determining the output voltage as a function of the frequency distribution comprises the step of determining the output voltage as a function of the m-th power of a value of the frequency distribution, m being greater than 1.

11. A knocking control method for an internal combustion engine as set forth in claim 7, further comprising the step of determining the distribution of the frequency of the knocking with respect to the strength of the knocking generated during the combustion cycles, the step of determining the output voltage as a function of the strength of the knocking and the frequency of the knocking comprises the step of determining the output voltage as a function of the n-th power of mean values of the knocking strength during the combustion cycles and of the m-th power of a value of the frequency distribution, n and m being greater than 1.

12. A knocking control method for an internal combustion engine as set forth in claim 1, wherein the step of generating control signals for controlling the knocking in the at least one cylinder comprises the step of varying an output voltage of the control signals as a function of the strength of the knocking.

13. A knocking control method for an internal combustion engine as set forth in claim 12, wherein the step of varying the output voltage of the control signals as a function of the strength of the knocking comprises the step of varying the output voltage as a function of the n-th power of a value of the strength of the knocking, n being greater than 1.

14. A knocking control method for an internal combustion engine as set forth in claim 1, further comprising the step of determining the frequency of the knocking in the at least one cylinder based on the knocking signal obtained during a number of combustion cycles, the step of generating control signals for controlling the knocking in the at least one cylinder comprising the step of varying an output voltage of the control signals as a function of the strength of the knocking and the frequency of the knocking obtained during the combustion cycles.

15. A knocking control method for an internal combustion engine as set forth in claim 14, wherein the step of varying the output voltage as a function of the strength of the knocking and the frequency of the knocking comprises the step of varying the output voltage as a function of mean values of the strength of the knocking and the frequency of the knocking.

16. A knocking control method for an internal combustion engine as set forth in claim 14, further comprising the step of determining the distribution of the frequency with respect to the strength of the knocking generated during the combustion cycles, the step of varying the output voltage as a function of the strength of the knocking and the frequency of the knocking comprising the step of varying the output voltage as a function of the frequency distribution.

17. A knocking control method for an internal combustion engine as set forth in claim 16, wherein the step of varying the output voltage as a function of the frequency distribution comprises the step of varying the output voltage as a function of the m-th power of a value of the frequency distribution, m being greater than 1.

18. A knocking control method for an internal combustion engine as set forth in claim 14, further comprising the step of determining the distribution of the frequency with respect to the strength of the knocking generated during the combustion cycles, the step of varying the output voltage as a function of the strength of the knocking and the frequency of the knocking comprising the steps of varying the output voltage as a function of the n-th power of mean values of the strength of the knocking generated during the combustion cycles and of the m-th power of a value of the frequency distribution, n and m being greater than 1.

19. A knocking control method for an internal combustion engine as set forth in claim 1, further comprising the step of providing a knocking decision device in which the analysis of the knocking signal and the combustion signal from each primary filter circuit is performed and the decision as to the presence of knocking is made.

20. A knocking control method for an internal combustion engine as set forth in claim 4, further comprising the step of designing the filter of the combustion filter circuit to allow only frequency components exciting in the at least one cylinder to pass through.

21. A knocking control method for an internal combustion engine as set forth in claim 1, further comprising the step of forming digital signals representative of the vibrations detected by the at least one knocking sensor.

22. A knocking control method for an internal combustion engine as set forth in claim 21, wherein the step of forming the digital signals representative of the vibrations detected by the at least one knocking sensor comprises the step of providing an analog/digital converter for receiving analog signals of the vibrations detected by the at least one knocking sensor and outputting the digital signals.

23. A knocking control method for an internal combustion engine as set forth in claim 1, wherein the step of deciding whether knocking exists based on an analysis of the knocking signal and the combustion signal comprises the steps of calculating a ratio of a maximum value of the knocking signal to a maximum value of the combustion signal and using the ratio to decide whether knocking exists.

24. A knocking control method for an internal combustion engine as set forth in claim 1, wherein the step of deciding whether knocking exists based on an analysis of the knocking signal and the combustion signal comprises the steps of calculating a ratio of an effective value of the knocking signal to an effective value of the combustion signal and using the ratio to decide whether knocking exists.

25. A knocking control method for an internal combustion engine as set forth in claim 1, further comprising the step of arranging the at least one knocking sensor to detect vibrations from a plurality of cylinders of the engine.

26. A knocking control method for an internal combustion engine as set forth in claim 1, further comprising the step of providing a plurality of knocking sensors and thus a plurality of respective primary filter circuits, the primary filter circuits having time gates of different specified times and filters of various, different specified frequency.

* * * * *